US007056272B2

(12) United States Patent
Moss

(10) Patent No.: US 7,056,272 B2
(45) Date of Patent: Jun. 6, 2006

(54) CENTRIFUGE HAVING AN EMERGENCY OFF SYSTEM

(75) Inventor: Reinhard Moss, Ennigerloh (DE)

(73) Assignee: Westfalia Separator AG, Oelde (DE)

( * ) Notice: Subject to any disclaimer, the term of this patent is extended or adjusted under 35 U.S.C. 154(b) by 217 days.

(21) Appl. No.: 10/673,233

(22) Filed: Sep. 30, 2003

(65) Prior Publication Data

US 2004/0072666 A1 Apr. 15, 2004

(30) Foreign Application Priority Data

Oct. 11, 2002 (DE) ..... 102 47 646

(51) Int. Cl.
*B04B 11/04* (2006.01)

(52) U.S. Cl. ..... 494/5; 494/12; 494/30; 494/37; 494/82

(58) Field of Classification Search ..... 494/1, 494/5, 6, 10, 12, 23–30, 37, 82; 210/144
See application file for complete search history.

(56) References Cited

U.S. PATENT DOCUMENTS

| | | | | |
|---|---|---|---|---|
| 4,206,871 | A * | 6/1980 | Nilsson | 494/10 |
| 4,643,709 | A * | 2/1987 | Lee et al. | 494/37 |
| 6,475,131 | B1 * | 11/2002 | Yoshida et al. | 494/27 |
| 2004/0043884 | A1 * | 3/2004 | Nyberg | 494/25 |
| 2004/0063562 | A1 * | 4/2004 | Hamatschek et al. | 494/82 |
| 2004/0072666 | A1 * | 4/2004 | Moss | 494/37 |

FOREIGN PATENT DOCUMENTS

| | | | |
|---|---|---|---|
| CH | 203503 | * | 6/1939 |
| DE | 651 907 | | 10/1937 |
| DE | 1 679 855 | | 4/1971 |
| DE | 2046 274 | | 5/1971 |
| DE | 1782647 | * | 8/1971 |
| DE | 33 20 152 A1 | | 6/1984 |
| DE | 3516735 | * | 11/1986 |
| DE | 4300199 | * | 9/1994 |
| GB | 1226483 | * | 3/1971 |
| GB | 1 253 799 | | 11/1971 |
| JP | 6-343900 | * | 12/1994 |
| JP | 8-131890 | * | 5/1996 |
| JP | 08131890 | | 5/1996 |

* cited by examiner

*Primary Examiner*—Charles E. Cooley
(74) *Attorney, Agent, or Firm*—Barnes & Thornburg LLP

(57) ABSTRACT

The present disclosure relates to a centrifuge having a vertical axis of rotation, and including a centrifugal drum having a feeding tube for material to be centrifuged, outlet nozzles, and an emergency off system connected in front of the centrifugal drum. The emergency off system includes a feeding system feeding particles into the centrifugal drum. The present disclosure also relates to a method of implementing an emergency off system of the centrifuge. The method steps include: providing an emergency off signal; feeding the particles into the centrifugal drum in response to the emergency off signal; and, wherein the particles plug the outlet nozzles.

15 Claims, 1 Drawing Sheet

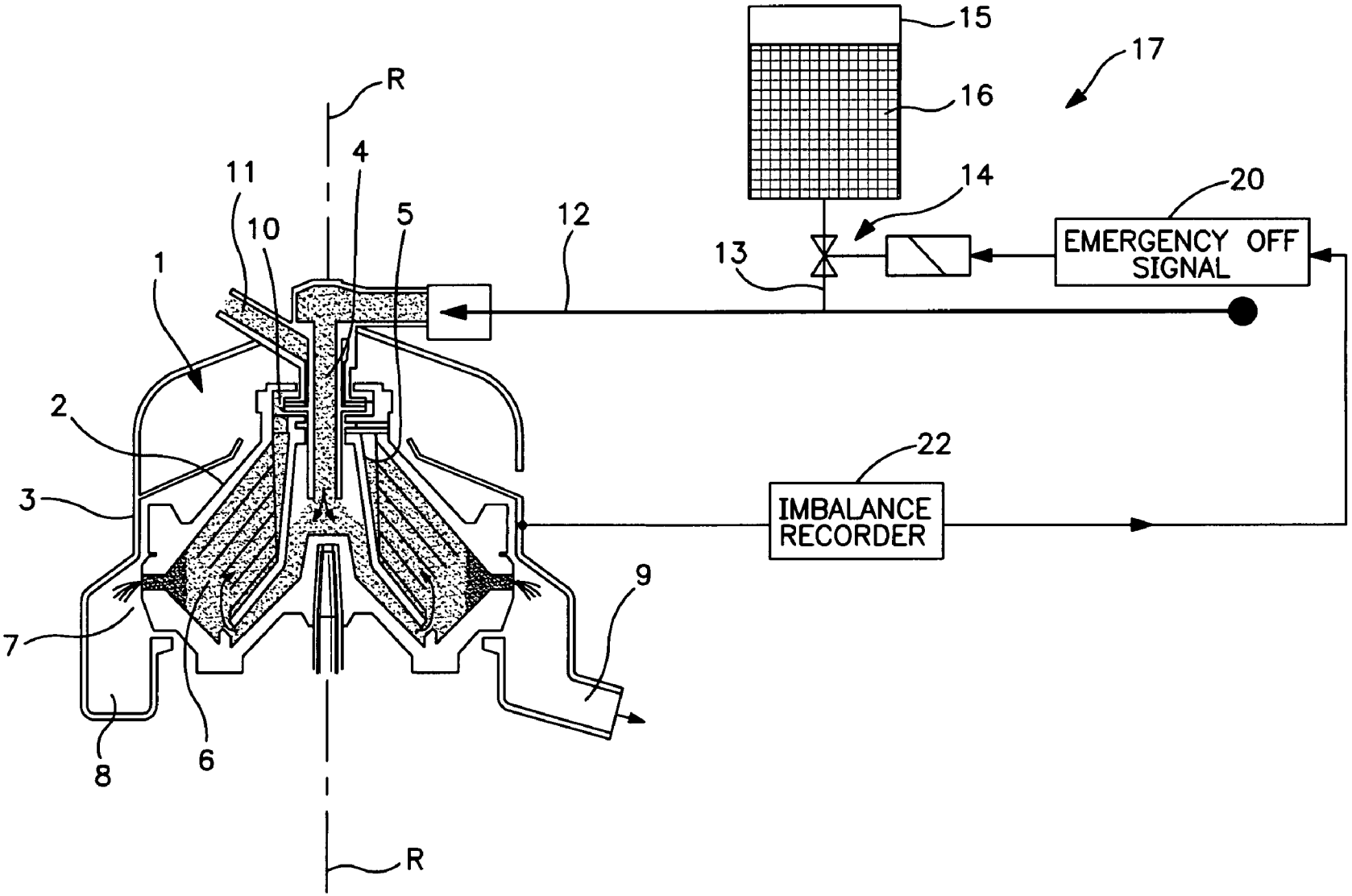
EMERGENCY OFF SIGNAL
IMBALANCE RECORDER
17
20
15
16
14
13
22
12
9
5
4
R
R
10
11
1
2
3
7
8
6

CENTRIFUGE HAVING AN EMERGENCY OFF SYSTEM

CROSS-REFERENCE

This non-provisional application claims the benefit of German Application Number 102 47 646.2-23, filed in Germany on Oct. 11, 2002, which disclosure is hereby incorporated herein.

BACKGROUND

The present disclosure relates to a centrifuge, particularly a separator with a vertical axis of rotation and having a centrifugal drum. The centrifuge is equipped with a feeding tube for material to be centrifuged as well as with outlet nozzles, and an emergency off system being connected in front of the centrifugal drum. The present disclosure also relates to a method of implementing the emergency off function or system of the centrifuge.

A centrifuge including a separator with a vertical axis of rotation, and including a centrifugal drum having a feeding tube for material to be centrifuged, outlet nozzles and an emergency off system connected in front of the centrifugal drum, is known from German Patent Document DE 651 907 C.

German Patent Document DE 33 20 152, which is of a different type, shows a return valve with a ball arranged on a spring.

From German Patent Document DE 2 046 274 A, it is also known to close outlet openings of a centrifuge in the event of an emergency in the case of a major unbalanced mass.

For example, as a result of the occurrence of imbalances, it may be necessary to manually or automatically switch off a separator. Imbalances may be caused by a one-sided clogging of individual nozzles because the solids are no longer discharged in these areas. For example, a centrifuge is known which is constructed as a separator with a vertical axis of rotation and has a nozzle drum above which, for the implementation of an emergency-off system, an emergency off container is arranged which leads into the inlet of the separator and has the purpose of receiving a liquid, such as water.

In an emergency off case, the product feeding is stopped as a rule, and a switch-over takes place to water, in order to avoid losses.

Since the centrifugal drum may continue to rotate for minutes until it stops, after the activation of the emergency off function, liquid will be directed into the centrifugal drum until the latter comes to a stop, so that the negative effect of the unbalanced mass will not be increased by the draining-off of the nozzle drum (loss of the balancing liquid). The emergency off container therefore has to take in, for example, up to 10 $m^3$ of water.

The relatively large space requirement of the emergency off container and its relatively high costs are not favorable in this case.

SUMMARY

The present disclosure relates to a centrifuge having a vertical axis of rotation, and including a centrifugal drum having a feeding tube for material to be centrifuged, outlet nozzles, and an emergency off system connected in front of the centrifugal drum. The emergency off system includes a feeding system feeding particles into the centrifugal drum.

The present disclosure also relates to a method of implementing an emergency off function or system of a centrifuge, the centrifuge having a vertical axis of rotation, and including a centrifugal drum having a feeding tube for material to be centrifuged, outlet nozzles and an emergency off system connected in front of the centrifugal drum. The method steps include: providing an emergency off signal; feeding the particles from a feeding system of the emergency off system into the centrifugal drum in response to the emergency off signal; and, wherein the particles plug the outlet nozzles.

By use of particles or solid particles, such as the balls, in an emergency off situation, the drum is stopped or "brought to a stop" within a short time without water or only with the addition of a little more water. Since the centrifugal drum can no longer drain completely, the risk of "rising imbalance forces" is reduced, which risk occurs when, during an imbalance, the centrifugal drum is emptied at a high rotational speed. This increases the influence of the imbalance on the centrifugal drum since the balancing effect of the product or of the water is eliminated.

A solids discharge is equipped with outlet nozzles, and the balls have a larger diameter than a diameter of the outlet nozzles.

A container, with the balls, can be dimensioned to be much smaller and is therefore more cost-effective than the water tank of the prior art because only as many balls are required as are necessary for plugging the outlet nozzles.

Although the centrifugal drum has to be opened after an activation of the emergency off system in order to remove the particles, particularly the balls, this opening generally is required anyhow in an emergency off case because of the unbalanced masses, so that, as a rule, no additional expenditures occur as a result of the removal of the balls from the centrifugal drum.

The particles, particularly the balls, may have a diameter at least 5% larger than a diameter of the outlet nozzles.

The particles, or the balls, may include rubber or a plastic material or, for avoiding problems with respect to hygiene or the like, of dried or possibly pressed solids of the material to be processed.

The particles or balls, may be introduced under pressure into the centrifugal drum.

Other aspects of the present disclosure will become apparent from the following descriptions when considered in conjunction with the accompanying drawings.

BRIEF DESCRIPTION OF THE DRAWINGS

The FIGURE is a view of a centrifuge, according to the present disclosure.

DETAILED DESCRIPTION OF THE DRAWINGS

The FIGURE illustrates a centrifuge, constructed as a separator 1, with a vertical axis of rotation R and which has a centrifugal drum 2, for example, a nozzle drum, which is surrounded by a hood 3.

The centrifugal drum 2 has a feeding tube 4 that feeds material to be centrifuged. The feeding tube 4 extends from above into the centrifugal drum 2 and leads into a distributor 5 from which the material to be centrifuged is guided into the centrifuge chamber 6 of the centrifugal drum 2. As an alternative, a feeding from below by a spindle (not shown) into a different distributor (not shown), or the distributor 5, is also conceivable. The spindle may act as an inflow tube.

For discharging the material from the nozzle drum 2, at least one solids discharge for a more solid phase and at least one liquid discharge for a more liquid phase is provided. The solids discharge is implemented by the outlet nozzles 7 which are distributed on a circumference of the centrifugal drum 2. The solids discharge may, for example, be constructed in a tubular slide valve through which the solids are guided into a solids catching device 8 and are guided from there into a discharge duct 9. In contrast, the liquid outlet or discharge is provided by a rotary-cut disk 10 which leads into a discharge 11.

A feed line 12 is connected in front of the feeding tube 4 and is arranged above the centrifugal drum 2. A branch pipe 13, which is equipped with a valve 14 connected in front of the feeding tube 4, leads into the feed line 12. The valve 14, at an end facing away from the feed line 12, leads into a container 15 for receiving particles, particularly balls 16. The balls 16, for example, may be made of one or more of rubber or plastic or dried solids, and which balls 16 have a larger diameter than a diameter of the outlet nozzles 7. An emergency off system, in the form of or including a feeding system 17, is adapted to feed the particles or balls 16 into the centrifugal drum 2, and may be implemented without major constructive expenditures.

In the event of an emergency, that is, when an "emergency off signal 20" is present or during a manual emergency operation, for example, because of a recorded imbalance of the centrifugal drum 2 by an imbalance recorder 22, the closed valve 14 opened up. The balls 16, for example, by water pressure or by a piston are pressed out or washed out of the container 15 through the branch pipe 13 via the valve 14, for example, a normally open valve, into the feed line 12. From there, the balls 16 flow into the feeding tube 4 until they finally enter through the distributor 5 into the centrifuging chamber 6, where they are centrifuged toward the outside because of their appropriately defined "greater" specific weight, so that they are deposited in front of the outlet nozzles 7 and plug the latter. As a result, the centrifugal drum 2 can stop or "come to a stop" without water or with the addition of only a little water. The container 15 may be prestressed, for example, by a compressed-air-actuated piston or the like. So that functioning is also maintained in the event of a power failure, the balls 16 can also float in the container 15 in a carrier liquid, such as water, in order to facilitate their feeding into the separator 1.

Since in the above-described condition of the emergency off system 17, the centrifugal drum 2 can no longer drain off completely, the risk of rising imbalance forces is reduced. The risk of rising imbalance forces occurs when, during an imbalance, the centrifugal drum 2 is drained at a high rotational speed, and this intensifies the effect of the imbalance on the centrifugal drum 2.

The container 15 with the balls 16 can be dimensioned to be smaller and is, therefore, more cost-effective than the water tank of the prior art.

Although the present disclosure has been described and illustrated in detail, it is to be clearly understood that this is done by way of illustration and example only and is not to be taken by way of limitation. The spirit and scope of the present disclosure are to be limited only by the terms of the appended claims.

The invention claimed is:

1. A centrifuge having a vertical axis of rotation and comprising:

a centrifugal drum having a feeding tube for material to be centrifuged;

outlet nozzles;

a recorder for generating an emergency off signal;

an emergency off system connected in front of the centrifugal drum, the emergency off system including a feeding system feeding particles into the centrifugal drum in response to the emergency off signal; and wherein the particles have a larger diameter than a diameter of the outlet nozzles, the particles plugging the outlet nozzles thereby permitting the centrifugal drum to come to a stop.

2. The centrifuge according to claim 1, wherein the particles include balls have a diameter which is at least 5% larger than a diameter of the outlet nozzles.

3. The centrifuge according to claim 1, wherein the particles having a greater specific weight than a liquid phase of the material to be centrifuged.

4. The centrifuge according to claim 1, wherein the particles include at least one of rubber and plastic material.

5. The centrifuge according to claim 1, wherein the particles include dried solids.

6. The centrifuge according to claim 1, wherein the feeding system includes a container for receiving the particles.

7. The centrifuge according to claim 6, wherein the container is constructed as a prestressed container.

8. The centrifuge according to claim 1, wherein the particles in the container are received in a carrier liquid.

9. The centrifuge according to claim 1, wherein a valve is connected in front of the feeding tube.

10. The centrifuge according to claim 9, wherein the valve is a normally open valve.

11. The centrifuge of claim 1, wherein the centrifugal drum includes a nozzle drum.

12. A method of implementing an emergency off system of a centrifuge, the centrifuge having a vertical axis of rotation and including a centrifugal drum having a feeding tube for material to be centrifuged, outlet nozzles and an emergency off system connected in front of the centrifugal drum, the method steps comprising:

providing an emergency off signal;

feeding the particles from a feeding system of the emergency off system into the centrifugal drum in response to the emergency off signal; and wherein the particles plug the outlet nozzles.

13. The method according to claim 12, wherein the particles are fed under pressure into the centrifugal drum.

14. The method of claim 12, wherein the particles include balls.

15. The method of claim 12, wherein the centrifugal drum includes a nozzle drum.

* * * * *